United States Patent [19]

Stumpp et al.

[11] 3,983,850

[45] Oct. 5, 1976

[54] APPARATUS FOR SUPPLYING FUEL FOR ACCELERATION DURING THE WARM-UP PHASE OF AN INTERNAL COMBUSTION ENGINE

[75] Inventors: Gerhard Stumpp, Stuttgart; Josef Steiner, Esslingen, both of Germany

[73] Assignee: Robert Bosch G.m.b.H., Stuttgart, Germany

[22] Filed: Jan. 3, 1975

[21] Appl. No.: 538,470

[30] Foreign Application Priority Data

Jan. 24, 1974 Germany ..... 2403278

[52] U.S. Cl. ..... 123/32 AE; 123/139 AW; 123/139 BG

[51] Int. Cl.[2] ..... F02M 51/00

[58] Field of Search ..... 123/139 AW, 139 BG, 123/179 L, 32 EA, 119 R, 32 AE

[56] References Cited

UNITED STATES PATENTS

| | | | |
|---|---|---|---|
| 3,437,081 | 4/1969 | Mennesson | 123/119 R |
| 3,616,780 | 11/1971 | Helle | 123/32 EA |
| 3,661,126 | 9/1969 | Baxendale | 123/32 EA |
| 3,673,989 | 7/1972 | Aono et al. | 123/32 EA |
| 3,734,067 | 5/1973 | Glocker et al. | 123/32 EA |

*Primary Examiner*—Charles J. Myhre
*Assistant Examiner*—Tony M. Argenbright
*Attorney, Agent, or Firm*—Edwin E. Greigg

[57] ABSTRACT

The invention relates to an apparatus for supplying fuel for acceleration during the warm-up phase of an internal combustion engine. The fuel supplied downstream of an arbitrarily actuatable throttle butterfly valve located in the induction tube of the engine being in addition to the fuel supplied by a fuel supply system. There is disclosed a motion control means which is associated with the butterfly valve and actuated thereby upon opening of this valve. The motion control means further includes electrical contacts disposed in an electrical circuit, electromagnet means in the circuit and other valve means arranged to be controlled by said electromagnet for feeding fuel into said induction tube downstream of said butterfly valve upon closing of said contacts. There are several variants of the control means; one constituted by a flexible bellows and the other by a dash pot.

8 Claims, 2 Drawing Figures

APPARATUS FOR SUPPLYING FUEL FOR ACCELERATION DURING THE WARM-UP PHASE OF AN INTERNAL COMBUSTION ENGINE

BACKGROUND OF THE INVENTION

The invention relates to an apparatus for supplying fuel for acceleration during the warm-up phse of an internal combustion engine in addition to the fuel supplied by a fuel supply system, the additional supply being introduced downstream of an arbitrarily actuatable throttle butterfly valve located in the induction tube of the engine.

It has been found that when an internal combustion engine is warming up, the fuel air mixture is steady state operation of the internal combustion engine can be adjusted to be substantially leaner than during a sudden opening of the throttle valve. Therefore, the emission of toxic matter and the fuel consumption can be reduced during the warm-up phase of an internal combustion engine by regulating a lean fuel-air mixture during the steady state operation of the internal combustion engine and to enrich the fuel air mixture for a short period of time during any sudden opening of the throttle butterfly valve.

In a known apparatus of this kind, the supply of fuel for acceleration in addition to the fuel air mixture prepared by the carburetor takes place downstream of an arbitrarily actuatable throttle valve in that a pneumatic control mechanism closes a pair of contacts in dependence on the change of the induction tube pressure whereby an electromagnet is energized and triggers the injection of the fuel for acceleration from a storage chamber out of an injection nozzle (see DT-AS No. 1 291 935). A disadvantage inherent in such an apparatus is that the mechanism responds to the opening motion of the throttle valve only after a certain amount of delay.

OBJECT AND SUMMARY OF THE INVENTION

It is an object of the invention to provide an apparatus of the known type described above which makes it possible to enrich the fuel air mixture by the supply of fuel for acceleration during a sudden opening of the throttle valve and during the warm-up phase of the internal combustion engine.

This object is attained according to the invention in that a setting or control mechanism is provided which is actuated by the opening motion of the throttle valve and which may close plural electrical contacts, said contacts being disposed in the electrical circuit of an electromagnet especially provided to actuate a valve.

A further development of the invention provides that the setting mechanism is embodied as a diaphragm bellows communicating via a throttle aperture with the atmospheric air and is actuated at one of its faces by a transmission pin and whose other end, which is locally fixed at the edge, is provided with an electrical contact. This development further provides that the opening motion of the throttle valve can be transmitted to the diaphragm bellows by means of a cam plate connected with the shaft of the throttle valve and cooperating with the transmitter pin.

The preferred development further provides that a temperature switch is disposed in the electric circuit of the electromagnet for interrupting the circuit after the termination of the warm-up phase of the internal combustion engine. The development provides that the temperature switch is embodied as a thermal time switch which limits the switch on time of the valve depending on the engine temperature.

A further advantageous development is such that the control mechanism is provided with a pair of contact holders, the first of which is connected with an actuating member and a second of which is connected with a damping rod to whose end remote from the contact carrier is mounted a damping plate which cooperates with a damping piston located in a damping medium. Those familiar with the art will recognize that the foregoing structure generally resembles a dash pot.

The further advantageous development also provides that the actuating member is moved by a spring acting on the first contact carrier in the direction of a cam plate coupled to the throttle valve shaft for transmitting the opening motion of the throttle valve to the setting mechanism. A further provision is that in the quiescent position of the throttle valve, the damping rod can be moved by a spring, acting via the damping plate, into a position in which the plural contacts of the two contact carriers do not touch. The development further provides that during a closure motion of the throttle butterfly valve, the damping plate opens an overflow bore of the damping piston.

The invention will be better understood as well as further objects and advantages become more apparent from the ensuing detailed specification of two different and exemplary embodiments taken in conjunction with the drawing.

DESCRIPTION OF THE PREFERRED EMBODIMENTS

Figure 1:
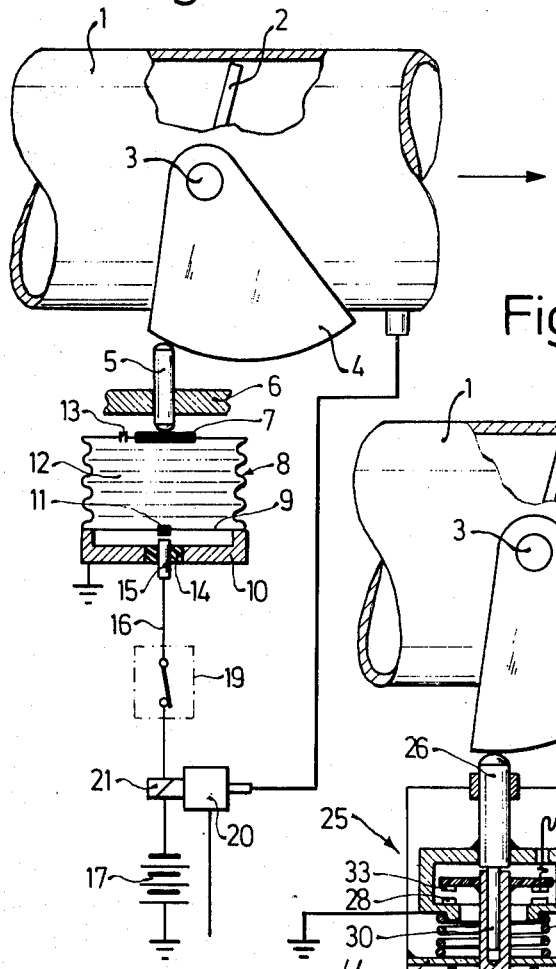
FIG. 1 depicts a portion of an induction tube and a camplate in cooperation with one type of control mechanism which is shown schematically in elevation.

Turning now to the drawings, in FIG. 1 may be seen a section or region 1 of an induction tube of an internal combustion engine containing an arbitrarily actuatable throttle valve 2 and a cam plate 4 mounted on the shaft 3 of the throttle valve. The cam plate 4 cooperates with a transmitting cam follower pin 5 guided in a holder 6 and whose end remote from the cam plate engages the element 7 supported by one flexible surface area of a diaphragm bellows 8. The opposite flexible surface area of the diaphragm bellows 8 is fixed locally on a base 10 and is provided with a central contact point 11. Chamber 12, formed by the diaphragm bellows 8, communicates via a throttle aperture 13 with the atmospheric air. An insulating insert 14 is mounted in the base 10 and is arranged to support an electrical contact 15. The electrical contact 15 is electrically connected with the positive terminal of an electric circuit 16 shown schematically, which is supplied by a current source 17 and which contains a thermal switch 19 and an electromagnet 21 for actuating valve 20. The thermal switch 19 can be embodied as a thermal time switch which limits the switch-on time of the electromagnet 21 and hence limits the amount of enrichment of the fuel-air mixture depending on the engine temperature.

The method of operation of the first exemplary embodiment as shown in FIG. 1 of an apparatus for supplying fuel for engine acceleration is as follows:

During the warm-up phase of the internal combustion engine, the fuel supply for the engine is furnished by means of a fuel supply system of known kind and not shown. In order to permit the enrichment of the fuel-air mixture, as regulated for steady-state operation of the engine, during an acceleration phase, the throttle valve shaft 3 carries a cam plate 4 which compresses the diaphragm bellows 8 via the transmitting pin 5 during any sudden opening of the throttle valve 2 whereby the increase of the pressure in the chamber 12 moves the lower flexible surface 9 carrying the electrical contact 11 toward the electrical contact 15 which closes the circuit 16 with the result of energizing the winding 21 of the electromagnet. The valve 20 can be embodied as an injection valve and can be connected to the pressure side of a fuel delivery pump, not shown, and able to inject fuel for purposes of acceleration into the induction tube downstream of the throttle valve 2 when the windings of the electromagnet are energized.

The duration of the enrichment process for acceleration may be predetermined by the choice of the size of the throttle aperture 13 as well as of the gradient of the cam plate, the diameter and the rigidity of the diaphragm bellows 8. The enrichment process for acceleration is interrupted when a pressure equalization has taken place through the throttle aperture 13 as between the chamber 12 and the atmospheric pressure. After this equalization, the electrical contacts 11 and 15 are opened and the circuit 16 is interrupted. Once the warm-up phase of the internal combustion engine has been terminated, the thermal switch 19 interrupts the circuit 16 so that no further enrichment for purposes of acceleration may take place.

Figure 2:
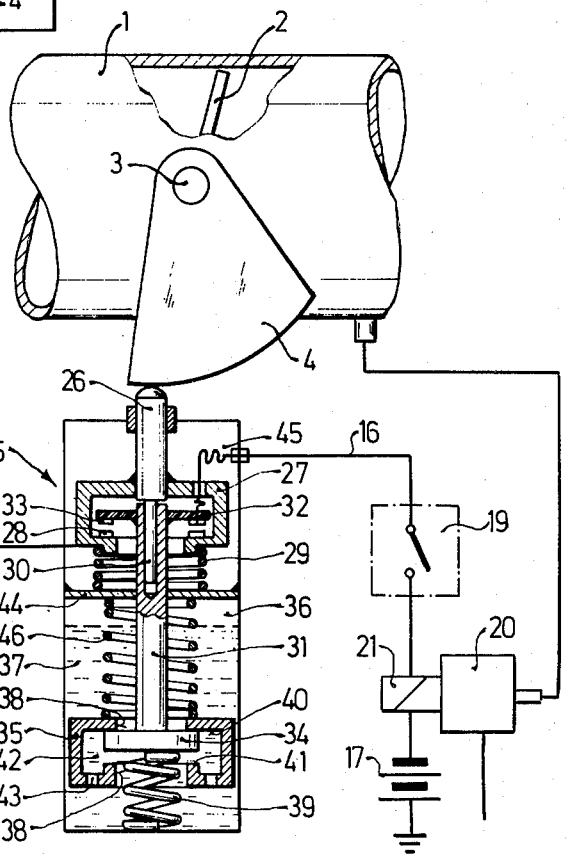
FIG. 2 is a second exemplary embodiment of another type of control mechanism also shown in cooperation with a cam plate associated with the induction tube.

In contrast with the first exemplary embodiment according to FIG. 1 whose control mechanism is a diaphragm bellows 8, the second exemplary embodiment according to FIG. 2 uses a modified control mechanism 25 in which the position of the throttle valve 2 is transmitted via the cam plate 4 onto an actuating member 26 which is connected to a first contact carrier 27 provided with electrical contacts 28. A spring 29 urges the first contact carrier 27 and the actuating member 26 against the cam plate 4. The end of the actuating member 26 remote from the cam plate is provided with an extending pin 30 slidingly and axially carrying a damping rod 31 and provided with a second contact carrier 32 with contacts 33 which cooperates with the first contact carrier 27. The end of the damping rod 31 remote from the second contact carrier 32 carries a damping plate 34 cooperating with a damping piston 35 which is slidably located in a chamber 36 of the setting mechanism 25 and which contains a damping medium 37, for example oil. The damping piston 35 is embodied as a hollow cylinder with an overflow aperture 38 which may be closed by the damping plate 34. A spring 39 normally presses the damping plate 34 in opposition to a spring 46 against one inner face 40 of the damping piston 35. A seat 41 is provided on the inner face opposite from inner face 40. The interior hollow space 42 of the damping piston 35, in addition to its communication through the overflow bore 38, also communicates with a damping medium through bores 43 located on the face opposite the interior face 40. The chamber 36 of the control mechanism 25 is separated from a chamber 45 by a transversely extending rigid wall 44, through which the damping rod 31 extends, and in which are located the contact carriers 27, 32 mounted on the actuating member 26 and on the damping rod 31, respectively. The end of spring 29 remote from the first contact carrier 27 is supported on the rigid wall 44. The electrical contacts 28 and 33 are located within an electrical circuit 16, such as shown in FIG. 1.

The method of operation of the second exemplary embodiment according to FIG. 2 is as follows:

In the quiescent state, the spring 39 holds the damping plate 34 in a position in which it is in firm contact with the inner face 40 of the damping piston so that it closes the overflow bore 38. During an opening motion of the throttle valve 2, the spring 29 attempts to hold the actuating member 26 in contact with the cam plate 4 which causes the actuating member 26 to move in the direction of the cam plate and the first contact carrier 27 and its contacts 28 touch the contact 33 of the second contact carrier 32. From this moment on, the motion of the actuating member 26 in the direction of the cam plate 4 is damped in that only a small amount of the damping medium 37 can flow past the exterior surface of the damping piston 35. Once the motion of the actuating member 26 has ended, the spring 39 moves the damping rod carrying the second contact carrier 32 in the direction of opening the contacts 28 and 33. When the throttle valve 2 is closing, the actuating member 26 and the damping rod 31 move the damping plate 34 in the direction of the seat 41 so that the damping medium may flow unthrottled past the damping piston 35 through the overflow bore 38, the hollow space 42 and the bores 43 so that it experiences virtually no damping in this direction of motion.

What is claimed is:

1. In an internal combustion engine having a fuel system, an induction tube, and an arbitrarily actuatable throttle butterfly valve located in said induction tube and having external rotary means affixed thereto; apparatus for supplying fuel for acceleration during the warm-up phase of said engine downstream of said throttle valve, the improvement comprising motion control means associated with the butterfly valve and actuated by said rotary means upon opening of said valve, said motion control means including a flexible diaphragm bellows arranged to be actuated by a pin member, said bellows further including at one end thereof means defining an opening therein in communication with the atmosphere and at the other end thereof electrical contacts disposed in an electrical circuit, electromagnet means in said circuit and second valve means arranged to be controlled by said electromagnet for feeding fuel into said induction tube downstream of said butterfly valve upon closing of said contacts.

2. An apparatus as described in claim 1, in which the said electrical circuit includes a temperature sensing switch disposed between the control means and said electromagnet.

3. An apparatus as described in claim 1, in which the motion control means includes a dash pot assembly, said dash pot assembly further including a chamber, an apertured piston having oppositely disposed surfaces positioned in said chamber, flexible means in cooperative arrangement disposed on opposite sides of said piston, split shaft means carried by said piston extending through a wall of said chamber, electrical contact means carried by each element of said split shaft means nd further flexible means interposed between the said wall and the electrical contact means.

4. An apparatus as described in claim 3, in which the said dash pot assembly further includes an actuating member arranged to cooperate with the rotary means coupled to the butterfly valve, and a first flexible means in said dash pot assembly urges the electrical contacts into a closed condition upon opening of said valve.

5. An apparatus as described in claim 3, in which the dash pot assembly further includes second flexible means to maintain the electrical contacts in an open condition.

6. An apparatus as described in claim 5 in which the dash pot assembly further includes a piston comprising axially aligned spaced walls including perforations adapted for cooperation with a reciprocable member positioned between and cooperable with said piston walls.

7. An apparatus as described in claim 2, in which the temperature sensing switch comprises a thermal time switch.

8. An apparatus as described in claim 5, in which the thermal time switch is activated by temperature of the internal combustion engine.

* * * * *